US007216435B2

(12) United States Patent
Siemers et al.

(10) Patent No.: US 7,216,435 B2
(45) Date of Patent: May 15, 2007

(54) ADJUSTABLE WOODEN SPOKESHAVE

(75) Inventors: Matthew Bruce Siemers, Ottawa (CA); Terry Ross Saunders, North Gower (CA)

(73) Assignee: Lee Valley Tools, Ltd., Ottawa (CA)

( * ) Notice: Subject to any disclaimer, the term of this patent is extended or adjusted under 35 U.S.C. 154(b) by 0 days.

(21) Appl. No.: 11/122,912

(22) Filed: May 5, 2005

(65) Prior Publication Data

US 2005/0260875 A1 Nov. 24, 2005

Related U.S. Application Data

(60) Provisional application No. 60/568,395, filed on May 5, 2004.

(51) Int. Cl.
*B27G 17/04* (2006.01)

(52) U.S. Cl. ..... 30/489; 30/487

(58) Field of Classification Search ..... 30/281, 30/312, 313, 487, 488, 489, 492
See application file for complete search history.

(56) References Cited

U.S. PATENT DOCUMENTS

| | | | | |
|---|---|---|---|---|
| 184 A | | 4/1837 | Becksmith | |
| 17,111 A | | 4/1857 | Packard | |
| 20,855 A | | 7/1858 | Bailey | |
| 23,927 A | | 5/1859 | Tolman | |
| 30,071 A | | 9/1860 | Leonard | |
| 40,437 A | | 10/1863 | Tuells | |
| 55,599 A | | 6/1866 | Bailey | |
| 176,151 A | | 4/1876 | Traut et al. | |
| 240,076 A | | 4/1881 | Bauer | |
| 357,898 A | | 2/1887 | Benson | |
| 383,590 A | | 5/1888 | Polhemus et al. | |
| 668,299 A | | 2/1901 | Traut | |
| 752,365 A | | 2/1904 | Spear | |
| 1,696,584 A | * | 12/1928 | Schwer | 30/489 |
| 1,825,859 A | * | 10/1931 | Foy | 30/489 |
| 1,929,504 A | * | 10/1933 | Macaller | 30/481 |
| 2,347,570 A | * | 4/1944 | Lavietes | 30/489 |
| 2,869,599 A | * | 1/1959 | Palm | 30/489 |
| 2,969,097 A | * | 1/1961 | Kulbersh et al. | 30/489 |
| 3,120,250 A | * | 2/1964 | Dakin | 30/487 |
| 4,015,649 A | * | 4/1977 | Gilbert | 30/487 |
| 5,111,584 A | * | 5/1992 | Iero et al. | 30/489 |

* cited by examiner

*Primary Examiner*—Hwei-Siu Payer
(74) *Attorney, Agent, or Firm*—Kilpatrick Stockton LLP; John S. Pratt; Camilla C. Williams

(57) ABSTRACT

A spokeshave providing an easily used depth of cut adjustment that is simple, effective and requires no extra tool or blade removal for adjustment. The blade of the spokeshave is mounted on two posts that project normal to the back of the blade, and the posts are received in structures adjustably positioned within the spokeshave body. Adjustment of the positions of the post-receiving structures cause the blade to move toward or away from the body.

11 Claims, 4 Drawing Sheets

ADJUSTABLE WOODEN SPOKESHAVE

RELATED APPLICATION DATA

This application claims priority to provisional application No. 60/568,395 filed May 5, 2004

FIELD OF THE INVENTION

This invention relates generally to hand woodworking tools called spokeshaves, and specifically to spokeshaves having a wooden handle and body and spokeshaves having adjustable blades.

BACKGROUND OF THE INVENTION

In spite of modern alternatives, traditional wooden spokeshaves are still popular tools. Such spokeshaves have an integrally formed body and handles made of wood, which is lightweight, easy to shape to suit the user, and pleasant to look at and use. They all share a common weakness; however, it is difficult to adjust depth of cut.

Normally wooden spokeshave blades are hand forged with upturned tangs that fit into holes pierced in the body of the shave. The tangs are wedged in position, and they are adjusted by tapping the ends of the tangs or the base of the blade, as required to move the blade toward or away from the body to adjust the depth and uniformity in thickness of cut. Various methods have been developed to improve this somewhat haphazard process. However, they are typically not very positive, or require the use of a tool such as a screwdriver or that the blade be completely removed to make even a small adjustment.

Metal body spokeshaves have developed thumbscrew arrangements for sliding a flat blade relative to the surface on which the blade's back surface (the blade surface that intersects the sharpening bevel) beds in order to adjust depth of cut. However, this type of structure will not work for a traditional wooden spokeshave, because the blade of a wooden spokeshave is adjusted by moving it normal to its back surface rather than in the same plane as that surface.

SUMMARY OF THE INVENTION

This invention is a spokeshave, and the metal components for making a wooden spokeshave, providing an easily used depth of cut adjustment that is simple, effective and requires no extra tool or blade removal for adjustment. In the spokeshave of this invention, the blade is mounted on two posts that project normal to the back of the blade, and the posts are received in structures adjustably positioned within the spokeshave body. Adjustment of the positions of the post-receiving structures cause the blade to move toward or away from the body.

DETAILED DESCRIPTION

Figure 1:
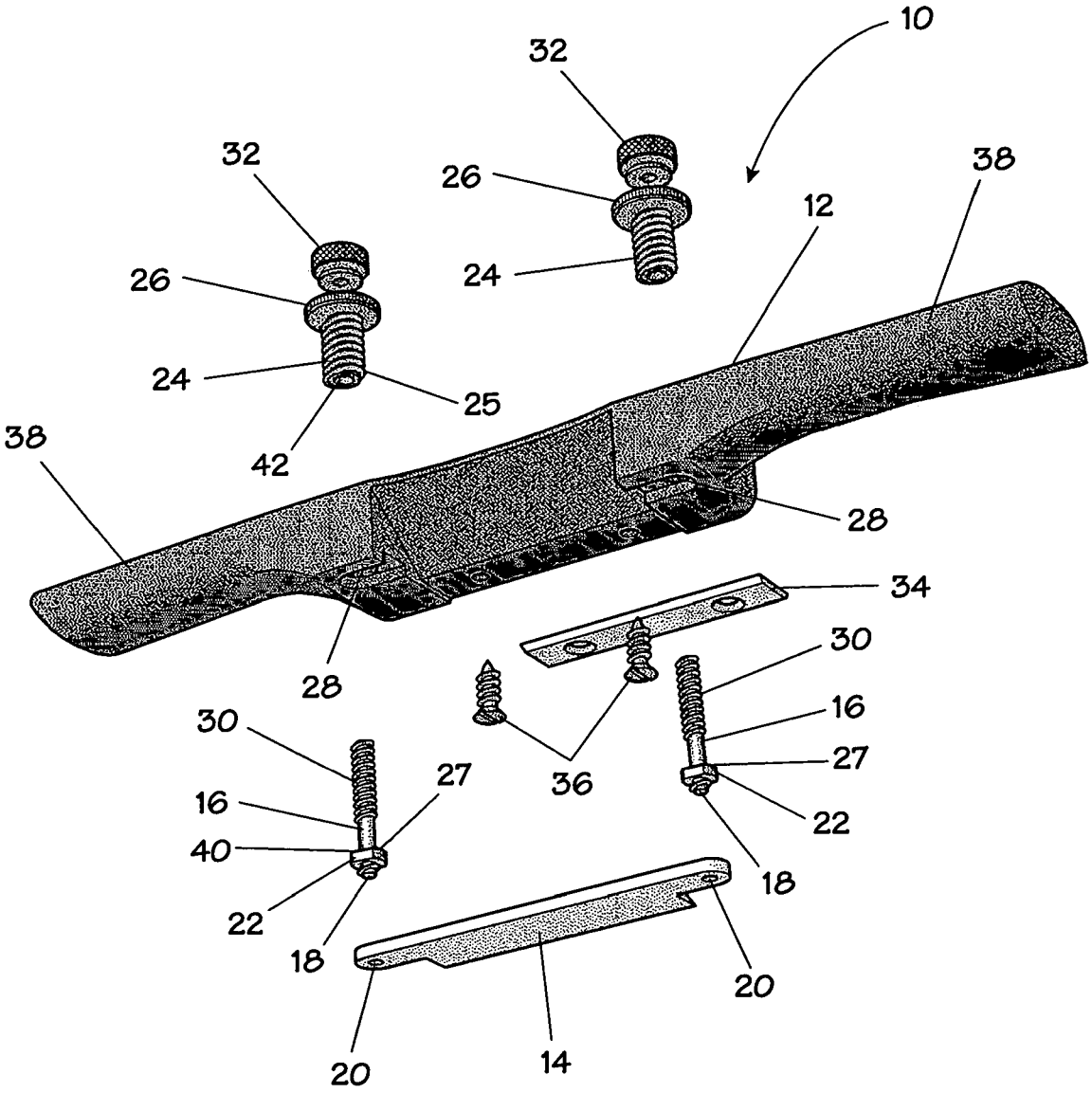
FIG. 1 is an exploded perspective view of the spokeshave and spokeshave making components of this invention.

As may be understood by reference to the drawings, the spokeshave 10 of this invention includes a body 12 to which a blade 14 is attached by posts 16 by screwing threaded lower ends 18 of posts 16 into threaded holes 20 in blade 14 and locking the posts 16 within blade 14 with locknuts 22. Each blade post 16 is received in a post receiver 24, which is a tube or sleeve threaded on the outside, smooth on the inside and having a knurled flange or thumb wheel 26 on one end.

Figure 2:
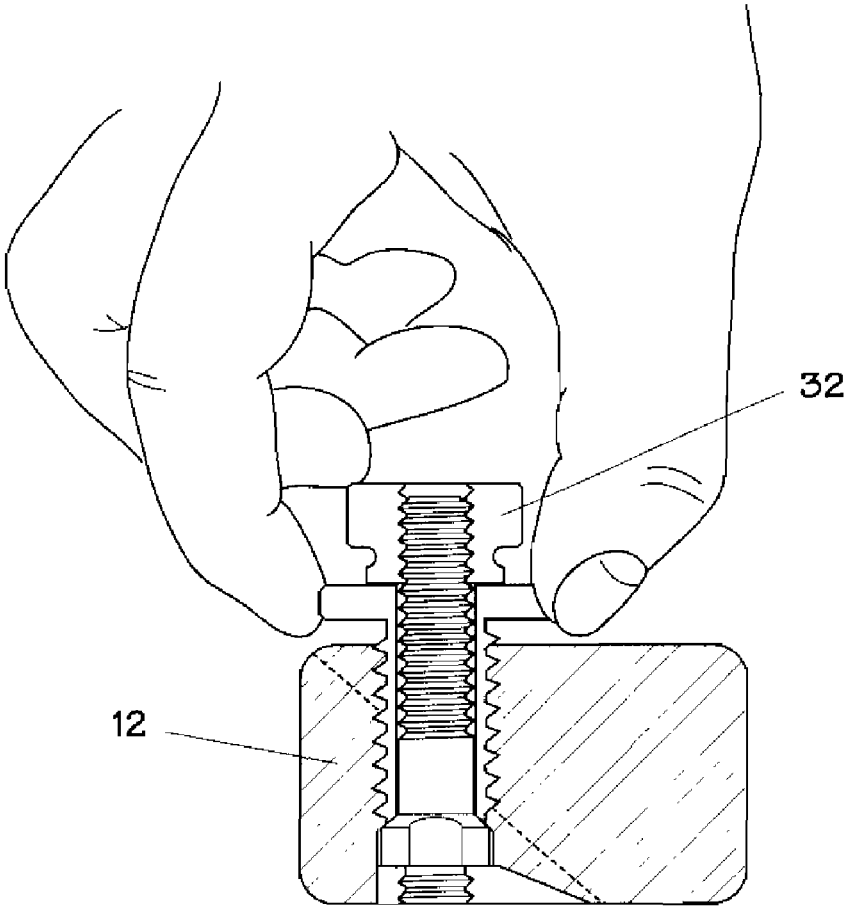
FIG. 2 is an end view, in section through the body and one blade holding and adjusting structure of this invention, showing manipulation of the structure to unlock it for adjustment.
Figure 3:
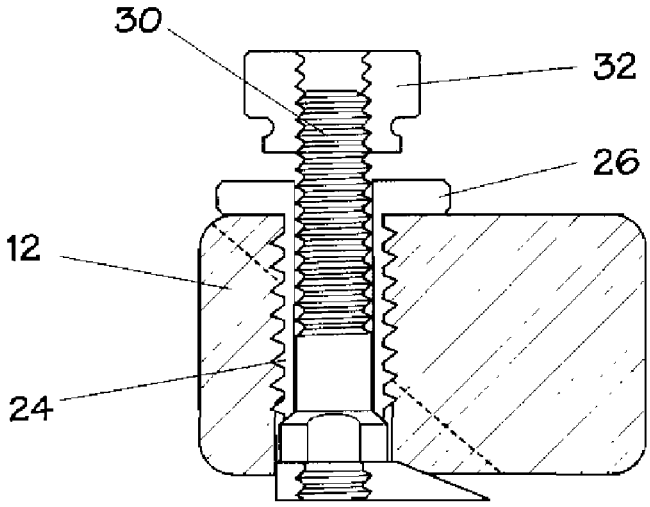
FIG. 3 is a view similar to FIG. 2 but with the locknut loosened so that blade position can be adjusted.
Figure 4:
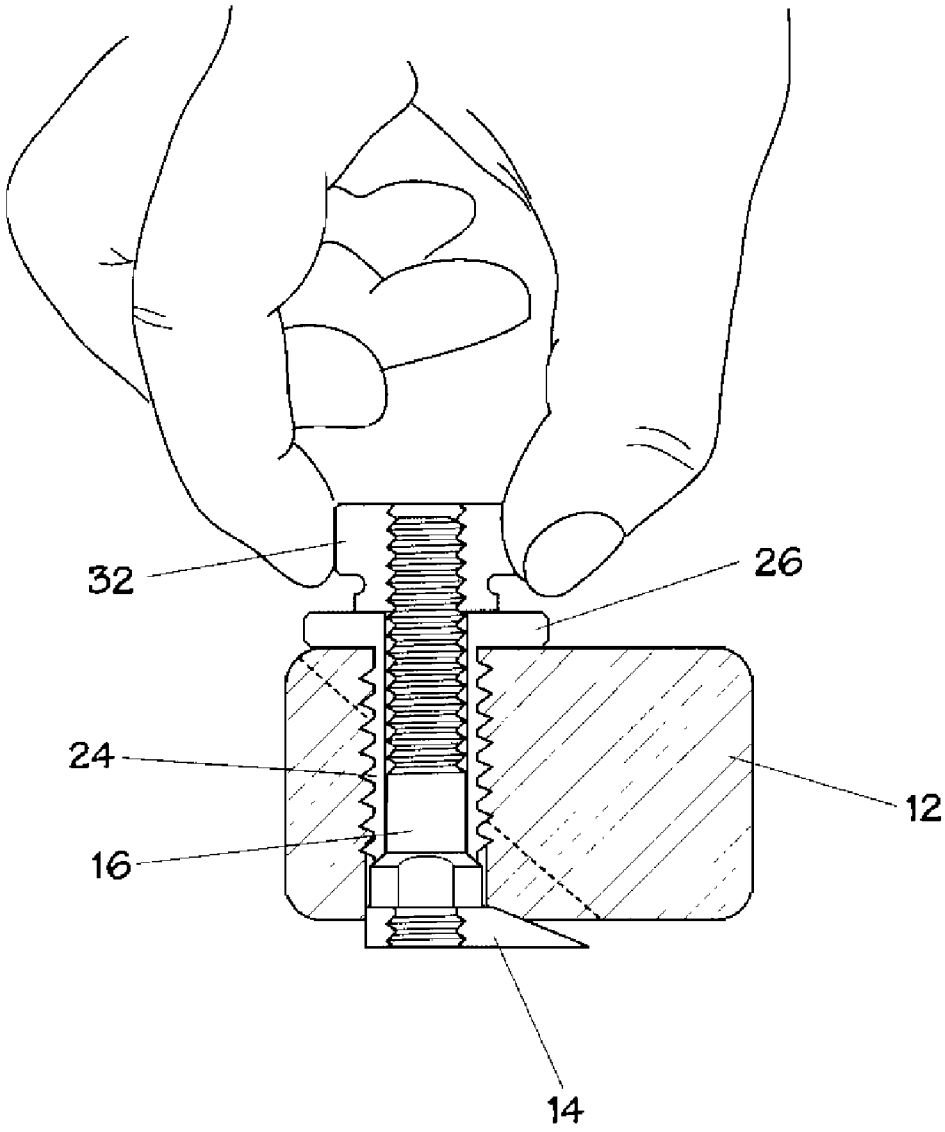
FIG. 4 is a second view similar to FIG. 2 but with the blade holding structure differently positioned.

As will be understood by reference to FIGS. 2, 3 and 4, each post receiver 24 is threaded into a threaded hole 28 in body 12. Post 16 is inserted in receiver 24, and the upper end 30 of post 16, which is also threaded, projects beyond the thumb wheel 26 and receives a knurled lock nut 32. Thus, during use of the spokeshave 10, lock nuts 32 are tightened, thereby trapping receiver 24 between locknut 22 near the blade and locknut 32 on the upper end 30 of post 16.

Blade "chatter" occurs in spokeshaves, planes and other similar tools if the geometries and materials of the tool permit the blade to in effect oscillate during use. This typically occurs where a blade or structures that hold the blade project far enough and are flexible enough to permit bending.

In a spokeshave having a blade attached to tangs or posts like posts 16, chatter can occur if the tangs or posts can bend or shift during use, thereby permitting the blade to move in the body during use. If the end 25 of receiver 24 is flat and bears against a flat surface associated with the post 16 or blade 14, the post can shift slightly within receiver 24 and thereby permit blade chatter.

Figure 5:
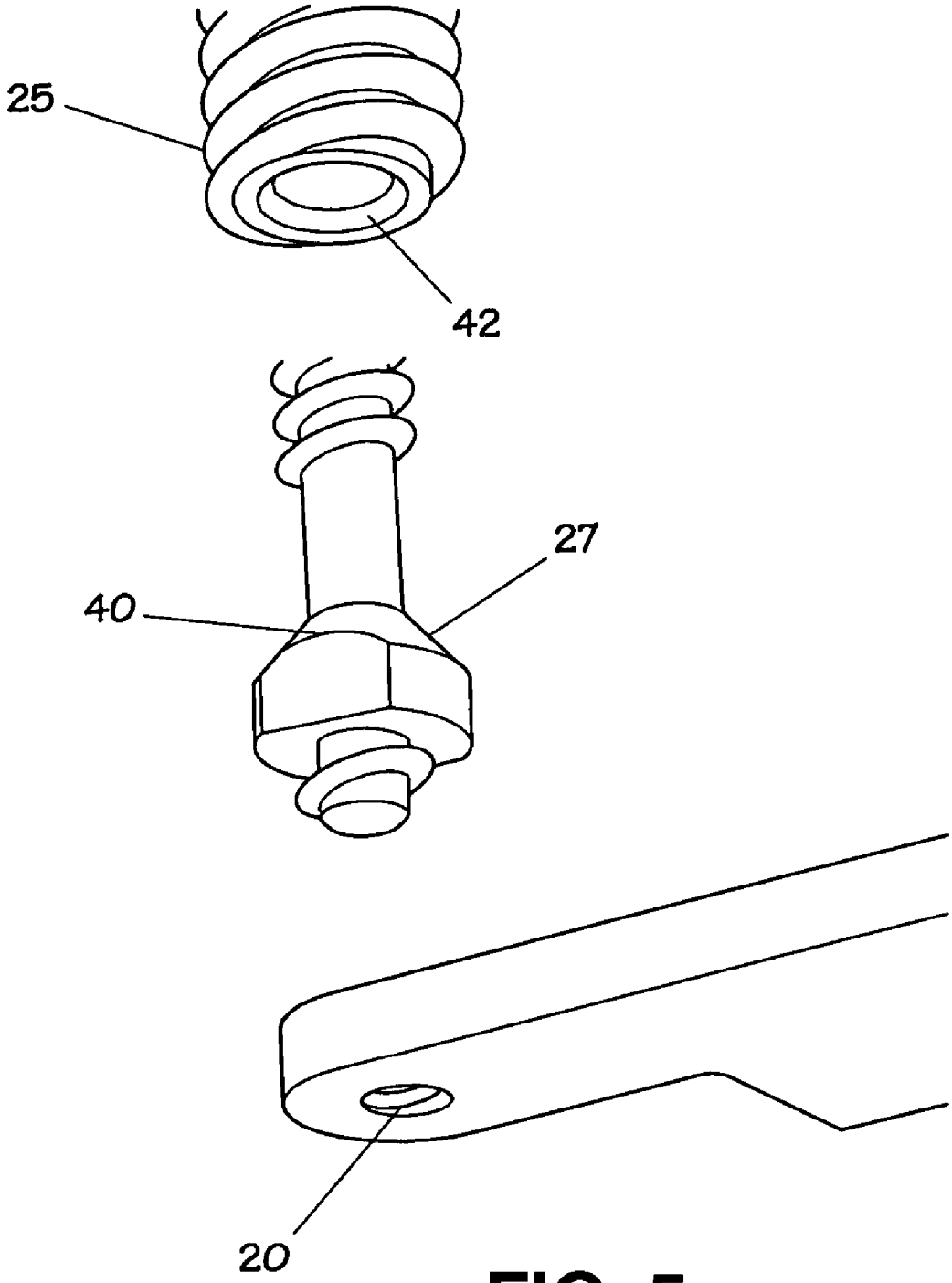
FIG. 5 is a partial exploded perspective view of a post and receiver and the blade of FIG. 1.

However, as shown in FIG. 5, if the end 25 of receiver 24 and a seating surface at the lower end 25 of post 16 or corresponding portions of one-piece blade and post structure interfit so as to resist relative movement during use, blade chatter will be prevented. Such interfitting surfaces can be provided by an inside chamfer 42 on receiver 24 forming an internal truncated conical surface and an external chamfer 40 on the top of locknut 22, thereby providing an interfitting external conical surface. Tightening forces conical surface 40 up into conical recess 42, thereby locking the lower end 25 of the receiver 24 to the nut 22 in a manner preventing relative movement between the lower end 25 of the receiver 24 and the end 27 post 16, thereby reducing the possibility of blade chatter.

In order to adjust blade 14 position, the locknuts 32 are loosened in order to permit post receivers 24 to rotate, and post receivers 24 are rotated by rotating thumbwheels 26 in order to advance or retract the blade by changing the positions of receivers 24 in body 12. Once the desired repositioning has occurred, locknuts 32 are rotated to lock them against thumbwheels 26 and thereby re-secure the blade 14 in a fixed position as posts 16 are locked within receivers 24.

As is easily seen in FIG. 1, a sole 34 is secured to body 12 with flat head wood screws 36. While the geometry of the body 12 where the blade 14 is attached will need to be appropriate to permit blade 14 to function and be adjusted properly, the handles 38 can be shaped to suit the user. While the body 12 has been described as "wood," it could also be made of a number of other materials, including metals such as brass, iron and steel and plastic and plastic composite materials such as glass filled nylon and other suitable plastics.

Since a wood handle may be fabricated by a user, the metal parts of the spokeshave 10 of this invention (all of the parts shown in FIG. 1 except for body 12) may be provided as a kit for combination with a purchaser-supplied or user-supplied body 12.

Blade 14 should be made of an appropriate type of steel, such as tool steel, including A2 tool steel. Posts 16 will typically be steel, although other metals could be used, and the other metal parts may be brass, steel or any other suitable materials.

As will be understood by those skilled in the art of tool design and manufacture, the spokeshave 10 of this invention could be made in a number of alternative configurations and using a number of alternative parts without departing from the spirit of this invention or the spirit scope of the following claims.

For instance, different arrangements of threads on posts 16, post receivers 24, locknuts 22 and locknuts 32 could be used, provided that such alternative structures provide a method of moving posts 16 in and out of body 12 in a controlled, incremental fashion with the ability to lock or otherwise secure the blade position is selectable desired alternative positions.

Among such possible alternatives, nuts 22 could instead be shoulders integrally formed on posts 16. As another alternative, posts 16 could be permanently attached to blade 14, although that is less desirable because it complicates sharpening blade 14. In yet another alternative structure, post receivers 24 could be threaded on the inside and configured to be rotatable within body 12 without changing position in body 12. Such rotation would thereby cause the associated post 16 to move into or out of body 12, and it could still be locked in position by a locknut 32.

The invention claimed is:

1. A spokeshave comprising:

(a) a spokeshave body having two handles, (b) a blade, (c) two posts for attachment to the blade, and (d) structure for securing the blade to the body so that the blade can be locked in alternative positions closer to or farther from the body and moved between such alternative positions by controlled increments, wherein the securing structure further comprises (e) a post receiver for threading into the body and for receiving one of the posts within the body and holding the one post in positions within the body determined by the position of the receiver within the body, and (f) a locknut for threading onto the one post to secure the one post to the receiver.

2. The spokeshave of claim 1, further comprising a rotating thumbwheel for advancing or retracting the blade.

3. The spokeshave of claim 1, wherein the receiver and the post further comprise mating surfaces.

4. The spokeshave of claim 3, wherein the mating surfaces comprise truncated conical surfaces.

5. The spokeshave of claim 1, wherein loosening the locknut allows rotation of the post receiver.

6. A kit for making a spokeshave using a spokeshave body, comprising:

(a) a blade, (b) at least one post for attachment to the blade, (c) a post receiver for threading into the body and for receiving the post within the body and holding the post in positions within the body determined by the position of the receiver within the body, and (d) a locknut for threading onto the post to secure the post to the receiver.

7. The kit of claim 6, further comprising a rotating thumbwheel for advancing or retracting the blade.

8. The kit of claim 6, wherein loosening the locknut allows rotation of the post receiver.

9. The kit of claim 1, wherein the receiver and the post further comprise mating surfaces.

10. The kit of claim 9, wherein the mating surfaces comprise truncated conical mating surfaces.

11. The kit of claim 1, further comprising a sole.

* * * * *